US010543966B2

(12) United States Patent
Schmidt

(10) Patent No.: US 10,543,966 B2
(45) Date of Patent: Jan. 28, 2020

(54) PRESSURIZED CLOSURE ASSEMBLY

(71) Applicant: Sypris Technologies, Inc., Louisville, KY (US)

(72) Inventor: William L. Schmidt, Leitchfield, KY (US)

(73) Assignee: Sypris Technologies, Inc., Louisville, KY (US)

( * ) Notice: Subject to any disclaimer, the term of this patent is extended or adjusted under 35 U.S.C. 154(b) by 0 days.

(21) Appl. No.: 16/163,696

(22) Filed: Oct. 18, 2018

(65) Prior Publication Data

US 2019/0047757 A1 Feb. 14, 2019

Related U.S. Application Data

(62) Division of application No. 15/003,157, filed on Jan. 21, 2016, now Pat. No. 10,118,745.

(60) Provisional application No. 62/106,662, filed on Jan. 22, 2015.

(51) Int. Cl.
*B65D 45/00* (2006.01)
*B65D 51/16* (2006.01)

(52) U.S. Cl.
CPC ..... *B65D 51/1688* (2013.01)

(58) Field of Classification Search
CPC .... B65D 51/1688; B65D 88/00; B65D 90/54; B65D 45/00; B65D 45/16; F17C 1/00
USPC ..... 220/315, 243, 200, 263, 816, 820, 823, 220/810–813, 846; 248/591; 292/251, 292/256, 256.5
See application file for complete search history.

(56) References Cited

U.S. PATENT DOCUMENTS

| | | | |
|---|---|---|---|
| 2,929,531 | A | 3/1960 | Kohlins |
| 2,954,141 | A | 9/1960 | Kramer et al. |
| 4,044,918 | A | 8/1977 | Alton |
| 4,470,516 | A | 9/1984 | Tsou |
| 4,739,899 | A | 4/1988 | Thompson et al. |
| 5,533,633 | A | 7/1996 | King |
| 5,918,756 | A | 7/1999 | Morgan |
| 6,085,935 | A | 7/2000 | Malchow |
| 6,851,452 | B2 | 2/2005 | Smith |
| 6,857,536 | B2 | 2/2005 | Smith |
| 7,243,685 | B2 | 7/2007 | White et al. |
| 7,341,161 | B2 | 3/2008 | McGuire |
| 7,896,187 | B2 | 3/2011 | Haibel |
| 8,083,087 | B2 | 12/2011 | Asterlin et al. |
| 8,251,243 | B2 | 8/2012 | Haibel |
| 8,540,103 | B2 | 9/2013 | Lollis et al. |
| 8,596,484 | B1 | 12/2013 | Haibel |
| 8,596,697 | B1 | 12/2013 | Haibel |
| 8,820,565 | B2 | 9/2014 | Akhund et al. |
| 9,056,701 | B1 | 6/2015 | Haibel et al. |
| 9,097,346 | B1 | 8/2015 | Rowland |

(Continued)

FOREIGN PATENT DOCUMENTS

WO 2003069195 8/2003

OTHER PUBLICATIONS

WSF Industries, Inc. Publication Modern Casting 91.8—Quick-Access Closures Aug. 2001.

*Primary Examiner* — Rafael A Ortiz
(74) *Attorney, Agent, or Firm* — Middleton Reutlinger

(57) ABSTRACT

A pressurized closure assembly is provided which has a connector assembly to allow improved application of torque in limited space conditions to rotate a head away from the hub of the closure assembly.

12 Claims, 16 Drawing Sheets

(56) References Cited

U.S. PATENT DOCUMENTS

| | | | | |
|---|---|---|---|---|
| 10,118,745 | B1 | 11/2018 | Schmidt | |
| 2003/0150864 | A1* | 8/2003 | Smith | G01M 17/007 220/315 |
| 2009/0260290 | A1 | 10/2009 | McQuaid | |

* cited by examiner

PRESSURIZED CLOSURE ASSEMBLY

CROSS-REFERENCE TO RELATED DOCUMENTS

This divisional patent application claims priority, under 35 U.S.C. § 121, to U.S. Non-Provisional application Ser. No. 15/003,157, filed Jan. 21, 2016 and titled "Pressurized Closure Assembly", which claims priority, under 35 U.S.C. § 119(e), to U.S. Provisional Application Ser. No. 62/106,662, filed Jan. 22, 2015, all of which is incorporated herein by reference.

BACKGROUND OF THE INVENTION

1. Field of the Invention

Present embodiments relate generally to a pressurized closure assembly. More specifically present embodiments relate to, but are not necessarily limited to, a pressurized closure assembly having a connector assembly to move a davit and head of the closure assembly.

2. Description of the Related Art

Closures for pressure vessels and pipes typically utilize a round door or head adapted to fit in or over the aperture of a closure hub. The hub is connected to a pressure vessel or pipe system or other structure which is typically pressurized. The door or head engages a hub so that the pressure vessel is closed but may be opened to access the interior of the hub and pressure vessel as needed.

In some head/hub arrangements, the head must be moved away from the opening of the hub. In the often cramped spacing of manufacturing facilities, structure is needed which can support the head and allow for movement in order to allow workers to access and/or enter the hub and pressure vessel, for example for inspection.

Unfortunately, the lack of space, the positioning of the head and hub, or a combination thereof, lead to problems with support and movement of the head. In limited space conditions, it is difficult for workers to manually move the head away from the hub due to inability to create enough torque which may be due to the location, surroundings and/or weight of the closure.

It would be desirable to provide a structure or assembly which more readily enables handling of a head and movement of the head in limited space conditions. Additionally, it is desirable to provide a structure or assembly which will support the high weight of the head and ease of movement, especially in awkward or confined handling configurations.

SUMMARY OF THE INVENTION

A pressurized closure assembly is provided which has a connector assembly to allow improved application of torque in limited space conditions to rotate a head away from the hub of the closure assembly.

According to some embodiments, a pressurized closure assembly comprises a hub which is connectable to a pressure vessel. The hub has a central opening. A head engages the hub and the head is movable between an opened and a closed position. A davit is positioned adjacent to the hub and extends upwardly to a position above the head for engagement with the head. A davit post mount is disposed near an end of the davit, the davit post mount receives a davit post and supports the head during movement between the opened and closed positions. The davit is pivotable about a substantially vertical axis. A connector assembly is disposed on the davit spaced from the vertical axis, said connector assembly which is connectable to said davit to apply force for rotating the davit and head and a bar connectable to the connector assembly at a first location and extending to a second location on an opposite side of the vertical axis.

Optionally, the head may be movable upwardly and downwardly by rotation of the head. The davit post mount and the davit post may be threaded. The connector assembly may be disposed on a horizontal portion of davit. The connector assembly may include a clamping bar and at least one plate. The at least one plate may have one of a connection aperture or a connection protuberance. The one of a connection aperture or said connection protuberance having a geometric shape and the geometric shape may comprise of square, hexagonal, or octagonal. The bar may have the other of a connection aperture or the protuberance of a mating shape. The connector assembly being adjustable along the davit toward or away from the vertical pivot axis. The connector assembly may be disposed at the davit post mount. In some embodiments, the connector assembly includes a plate. The plate may have one of a connection aperture or a connection protuberance. The plate may extend at least partially about the davit post mount.

According to some embodiments, a pressurized closure assembly comprises a hub which is connectable to a pressure vessel and a head which engages the hub. The head may be movable between an open position providing access to the hub and a closed position inhibiting access to an interior of the hub. A davit which is pivotable about a vertical axis to move the head between a first position above the hub and a second position away from the hub. A connector assembly is disposed on the davit and spaced from the vertical axis allowing connection of a bar to the davit. The bar is connectable to the connector assembly to pivot the davit and move the head away from the hub.

Optionally, the connector assembly comprises at least one plate welded on the davit. The at least one plate may being a first plate and a second plate. The at least one plate may have one of an aperture and a protuberance. The connector assembly may comprise an aperture formed in the davit. The connector assembly may comprise a protuberance welded to the davit. The connector assembly may include a clamp which is position adjustable along said davit. The connector assembly may further comprise a plate having one of an aperture or protuberance which is spaced from a horizontal axis of said davit. The bar may have a length such that a first end is located at the connector assembly and a second end is located on an opposite side of the vertical axis.

According to still a further embodiment, a pressurized closure assembly may comprise a hub which extends from a pressure vessel, the head having a peripheral rim and a central opening, a head which is positioned in the central opening of the hub. A davit extends from the hub and supports the head during lifting of the head from the hub. A connector assembly is located on the davit and has one of an aperture or a protuberance. A bar with a mating aperture or protuberance engages the connector assembly and aids pivoting of the davit.

All of the above outlined features are to be understood as exemplary only and many more features and objectives of these embodiments may be gleaned from the disclosure herein. Therefore, no limiting interpretation of this summary is to be understood without further reading of the entire specification, claims, and drawings included herewith.

BRIEF DESCRIPTION OF THE FIGURES

Embodiments, which may be preferred and exemplary, together with further objects and advantages thereof, are more particularly described in the following detailed description taken in conjunction with the accompanying drawings, in which.

DETAILED DESCRIPTION

Figure 1:
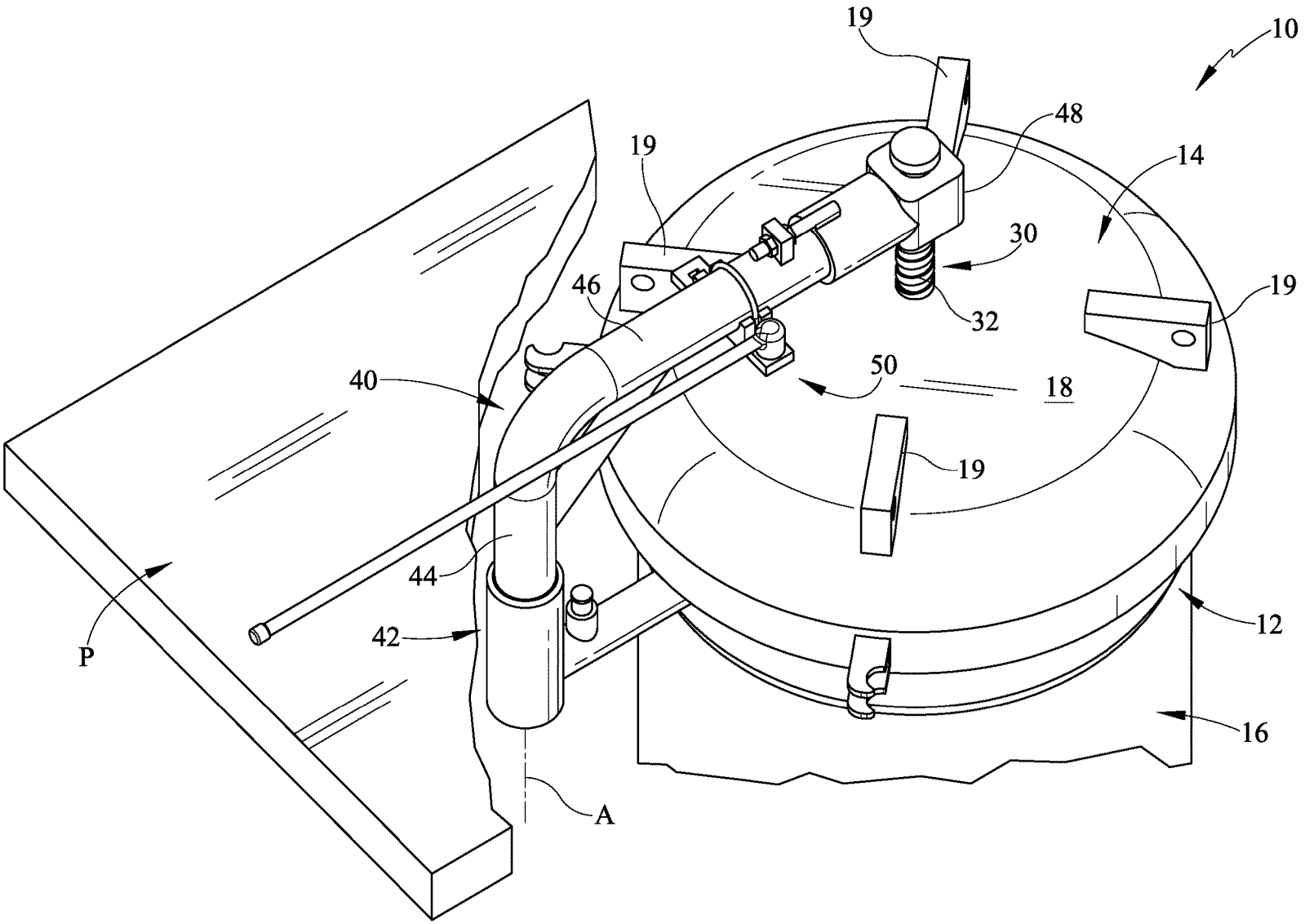
FIG. 1 is a perspective view of an isometric pressure vessel and closure assembly.

It is to be understood that the exemplary embodiments are not limited in their application to the details of construction and the arrangement of components set forth in the following description or illustrated in the drawings. The exemplary embodiments are capable of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify various embodiments and that other alternative mechanical configurations are possible.

As referred to herein, the term axially means in the direction of the axis of the hub. Also, the term radially refers to the direction of a radius, for example from the axis of the hub toward the outer circumference thereof, or vice-versa.

Referring to FIGS. 1-16, embodiments of a closure assembly for a pressurized system and which are utilized with a pressure vessel are shown and described. The embodiments provide that a head is removable from a hub to open access into the hub and pressure vessel. Further, connector assemblies are provided which aid users in moving the head once disconnected from the hub. The connector assemblies are helpful in close, confined spaces where users have difficulty rotating a heavy head away from a hub.

Referring initially to FIG. 1, the closure assembly 10 is depicted as an exemplary embodiment. The closure assembly 10 comprises a hub 12 and a head 14 which is connected to the hub 12. The closure assembly 10 is connected to a pressure vessel 16 which may be various structures including, but not limited to, a tank, a pipeline, or other enclosure subjected to pressure differential or pressurized container of selected volume. At times, it is desirable that the internal area of the vessel 16 be accessed for inspection and/or maintenance. As a result, the closure assembly 10 provides the ability to access the interior of the hub 12 and/or the pressure vessel 16.

Adjacent to the closure assembly is a platform P where a person may stand to perform maintenance. The platform P may be used in conditions where the closure assembly 10 is elevated or other means are needed to gain access to the closure assembly 10, and for maintenance thereof. However, platforms are generally small in size due in part to cost of materials and cost for construction. The platform P may be solid metal decking, expanded metal, or other structure upon which a user may stand. The platform P may be raised to the level of the head 14 or lowered some distance so that the head 14 may be comfortably accessed when standing on the platform P. Alternatively, the platform P may be positioned relative to a davit 40 rather than the head 14.

Figure 3:
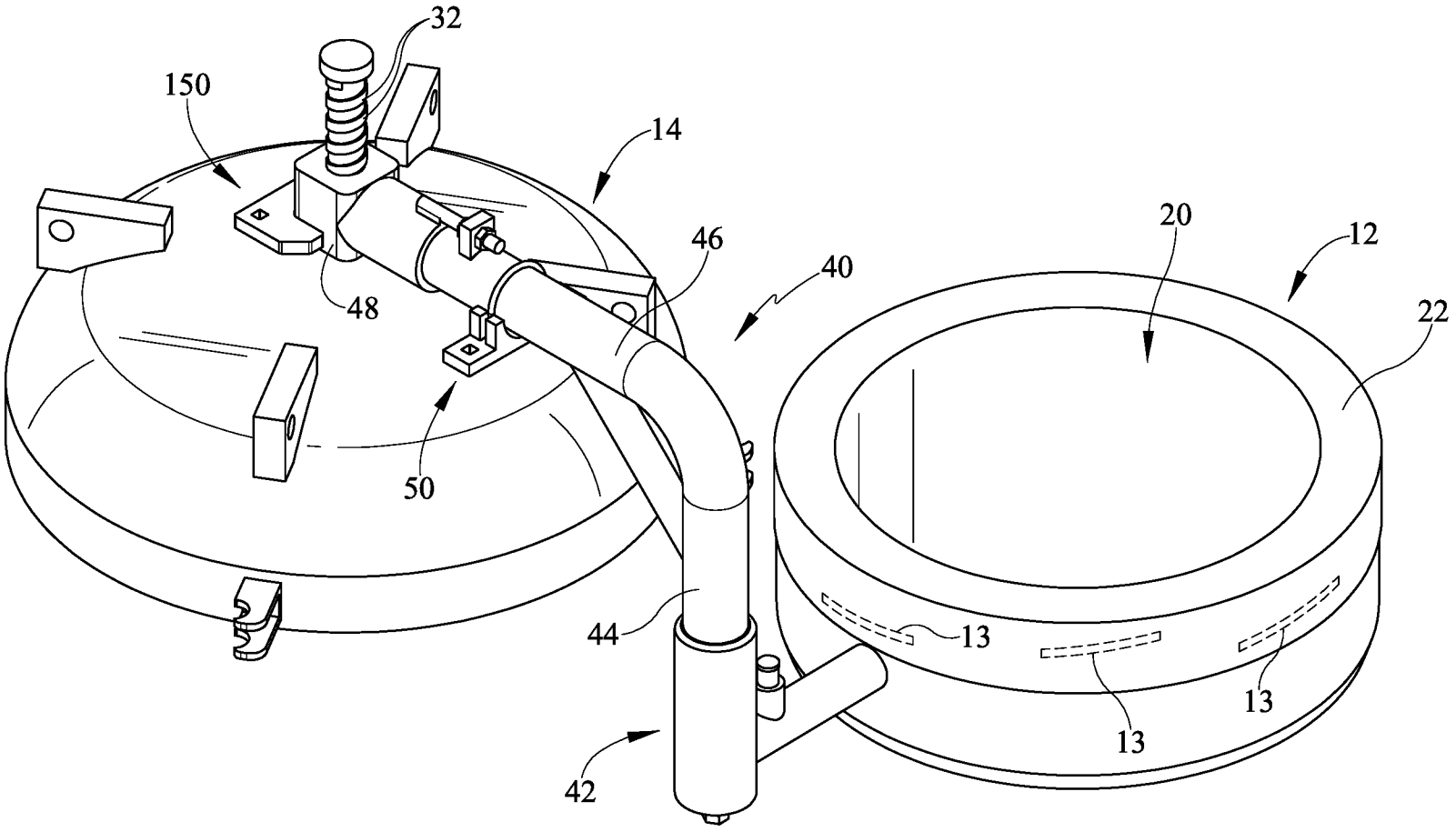
FIG. 3 is an isometric view of the closure assembly in an open position.

In the exemplary embodiment, the pressure vessel 16 has a circular cross-section and is generally represented by a pipe although other structures may be utilized. The hub 12 may also be annular in shape with a central bore 20 (FIG. 3) defined by a peripheral rim 22 (FIG. 3). The hub 12 may be welded to the pressure vessel 16 according to some embodiments. Alternatively, the hub 12 may be connected to the pressure vessel 16 by way of a flanged connection. Further, while circular cross-sections are common of closures, nothing in this disclosure should be construed as limiting head and hub shapes to circular.

The head 14 also has a substantially circular cross-section which engages the hub 12. In some embodiments, the head 14 may be sized with a diameter which is greater than the hub 12, so that the head 14 fits over the hub 12. Further, the closure assembly 10 may be formed so that the head 14 is smaller in diameter than the hub 12 and may fit within the opening 20 defined by the rim 22, as described in FIG. 13. Like the hub 12, the head 14 may be formed of high strength metallic material which is suitable for the high pressure uses common with manufacturing and industrial pressurized systems, for non-limiting example the oil and gas industry.

According to the instant embodiment, the head 14 may be connected to the hub 12 by a threaded engagement. For example, hub 12 may include radially outer threads which engage threads on a lower radially inner surface of the head 14. The closure assembly 10 allows access to the pressure vessel 16 or other system by way of the openable head 14. Other structures may be utilized for connecting the head 14 and the hub 12. For example, the head 14 may be sized to fit within the opening of the hub 12, rather than over the entire hub 12, and connected by a locking ring which moves at least radially inwardly and outwardly. The head 14 may be rotatable to engage or disengage the hub 12 allowing access to the vessel 16.

The head 14 has an upper surface 18 which may include a plurality of lugs 19. The lugs 19 may be used to lift the head 14 during manufacturing or installation. Additionally, extending from the upper surface 18 of the hub 12 may be a davit post 30 which provides at least two functions. First, the davit post 30 is threaded so that when the head 14 is rotated to remove the head 14 from the hub 12, the davit post 30 also rotates and supports the head 14 as it is removed from the hub 12. Further, the davit post 30 also causes the head 14 to raise as the head 14 is rotated. Thus the davit post 30 both moves the head 14 and supports the head 14.

In carrying out these functions, the head and hub threads 15 (FIG. 2), 13 (FIG. 3) may match the pitch of threads 32 on the davit post 30. The threads 32 should not bind the head 14 as the head 14 is unthreaded from the hub 12. Additionally, the threads 32 should also not bind when the head 14 is lowered and threadably connected to the hub 12.

Also shown in FIG. 1 is a davit 40 which is utilized to move the head 14 toward or away from the hub 12, when the head 14 is disconnected by way of rotation or pivoting movement. The davit 40 is a post structure which has a pivot assembly 42. The davit 40 has a first portion 44 which engages the davit pivot assembly 42 and a second portion 46 which extends horizontally over the head 14. The first portion 44 may extend vertically or may be at an angle to the vertical. The second portion 46 may also extend at an angle which is other than horizontal. The first portion 44 engages the pivot assembly 42 so that the davit 40, and specifically the first portion 44, may pivot or rotate about a vertical axis A.

The davit 40 may be connected to the hub 12 or may be connected to some structure adjacent the closure assembly 10 so that when rotated to the position shown, the head 14 may be positioned on or in the hub 12. Alternatively, the davit 40 allows for rotation to move the head 14 away from the hub 12 for access or inspection.

Referring still to FIG. 1, the closure assembly 10 further comprises a connector assembly 50. The connector assembly 50 provides a structure or assembly for connecting to the davit 40 and allows for increased application of torque to the davit 40 and raised head 14 in order to move the head 14 away from the hub 12. The connector 50 may be fastened or otherwise connected to the davit 40 or alternatively, may be integrally formed on the closure assembly 10.

Figure 2:
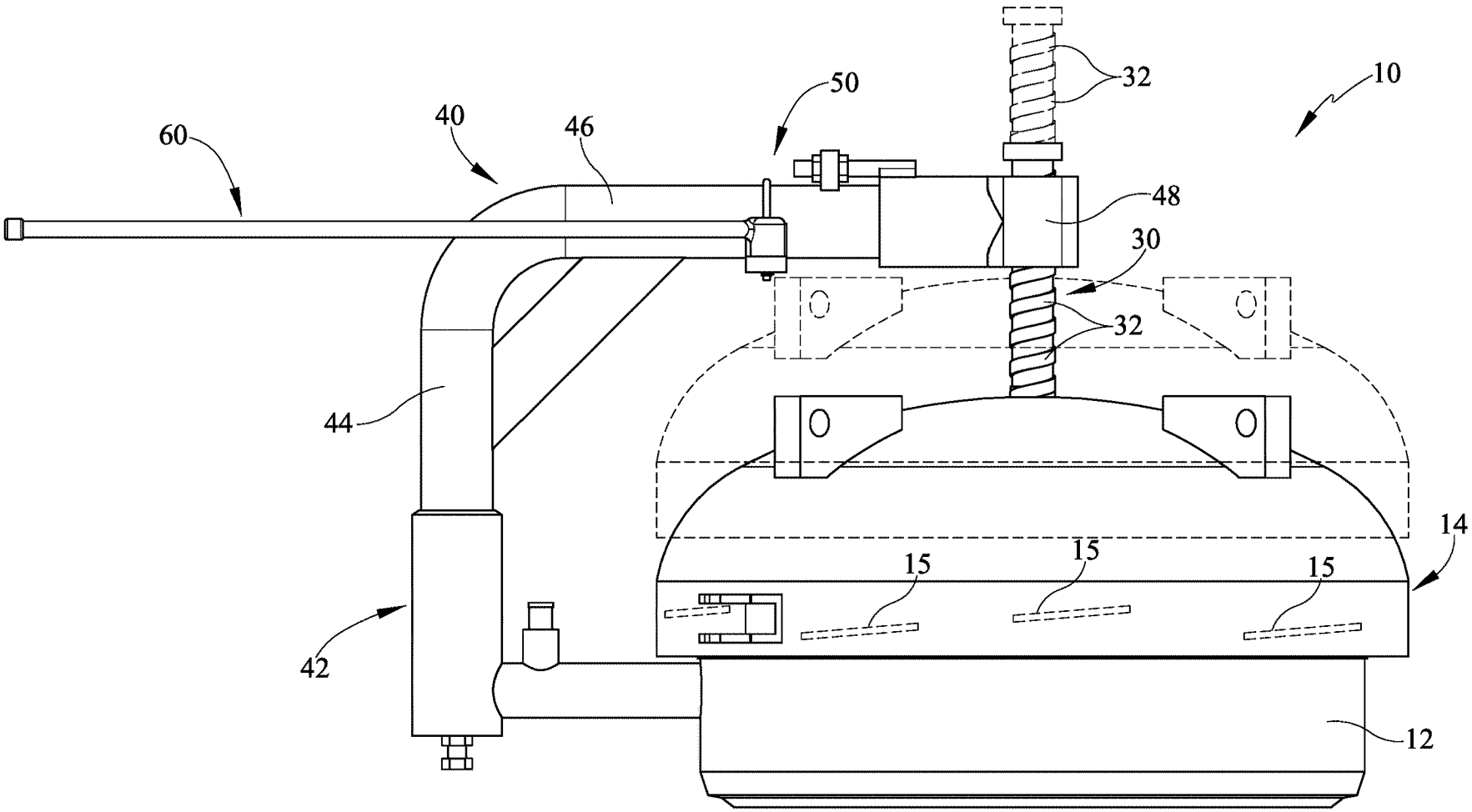
FIG. 2 is a side elevation view of the closure assembly.

Referring now to FIG. 2, the closure assembly of FIG. 1 is shown in side elevation view. The closure assembly 10 includes the head 14 and the hub 12. The head 14 is movable between a lower position engaging the hub 12, and shown in solid line, and an upper position disengaged from the hub 12, and shown in broken line. As previously discussed, according to one embodiment, the head 14 may be rotated to disengage from the hub 12. Alternatively, other head and hub arrangements may provide that the head 14 or other locking ring structures be moved to disengage so that the head 14 may be lifted from the hub 12. In the depicted embodiment, rotation of head 14 causes the head 14 to unthread from the hub 12 due to threads 13, 15 and also causes the head 14 to lift due to davit post threads 32.

As shown, the threads 15 of the head 14 are depicted in broken line. When the head 14 is lifted, the threads 13 of hub 12 may be seen as in FIG. 3. The head 14 of the instant embodiment rotates to disengage the hub 12 and the davit post 30 simultaneously moves upwardly through mount 48 while supporting the head 14 during the disengagement. The davit post threads 32 are also shown in broken line in this upper position.

At the end of the horizontal portion of the davit 40 is a davit post mount 48. The davit post 30 extends through the davit post mount 48, which also comprises threads to engage the davit post threads 32. The threads 32 are shown as substantially continuous. However, in other embodiments, the threads 32 may be discontinuous. Other features may be used to guide movement upwardly and downwardly and also rotationally.

Positioned between the davit post mount 48 and the vertical first portion 44 is a connector assembly 50. The connector assembly 50 is a structure which is connected to the davit 40 and includes a bar 60. The bar 60 provides a means to more easily rotate the head 14 and davit 40 when the head is lifted from the hub 12. The connector assembly 50 provides for engagement of the bar 60 to the remainder of the closure assembly 10. The connector assembly 50 may be positioned at various locations along the davit 40 and may be configured in various orientations.

Referring now to FIG. 3, an isometric view of the closure assembly 10 is shown with the head 14 moved to an open position. In such open position the head 14 allows access to a pipe or pressure vessel 16 (FIG. 1) or other pressurized system to which the closure 10 is attached. When the head 14 is in the closed position as shown in FIG. 1, the pipe system or pressure vessel to which the closure 10 is connected may be pressurized. In this view, the connector assembly 50 is shown, as well as an alternative embodiment of a second embodiment 150.

According to one embodiment, the connector assembly 50 is connected to the davit 40 and retained thereon for connection with the bar 60 (FIG. 1, 2). The bar 60 provides a structure which may be used in confined spaces to leverage turning of the davit and head 14. Due to the construction material and size of the closure assembly 10, the head 14 is extremely heavy and creating a force and torque large enough at the davit 40 to rotate the davit 40 and the head 14 about an axis through portion 44 is difficult, especially in tight quarters. The connector assembly 50 is located in some embodiments along the horizontal portion of davit 40. The connector assembly 50 is spaced from the axis defined by vertical portion 44.

According to a second embodiment, the connector assembly 150 is formed by a plate or block 152 which is connected to the davit post mount 48. This plate or block 152 may be provided to connect the bar 60 to leverage the head 14 toward or away from the hub 12. The connector assembly 150 may be fixed whereas the assembly 50 may be adjusted in position.

Additionally shown in FIG. 3 is a central opening or bore 20 of the hub 12. The interior of the hub 12 allows inspection of the pressure vessel 16 (FIG. 1). Also, the hub 12 allows access if the size accommodates such. The diameter of the bore 20 may be as small as six inches (6") and increases to much larger sizes, depending on the use.

Figure 4:
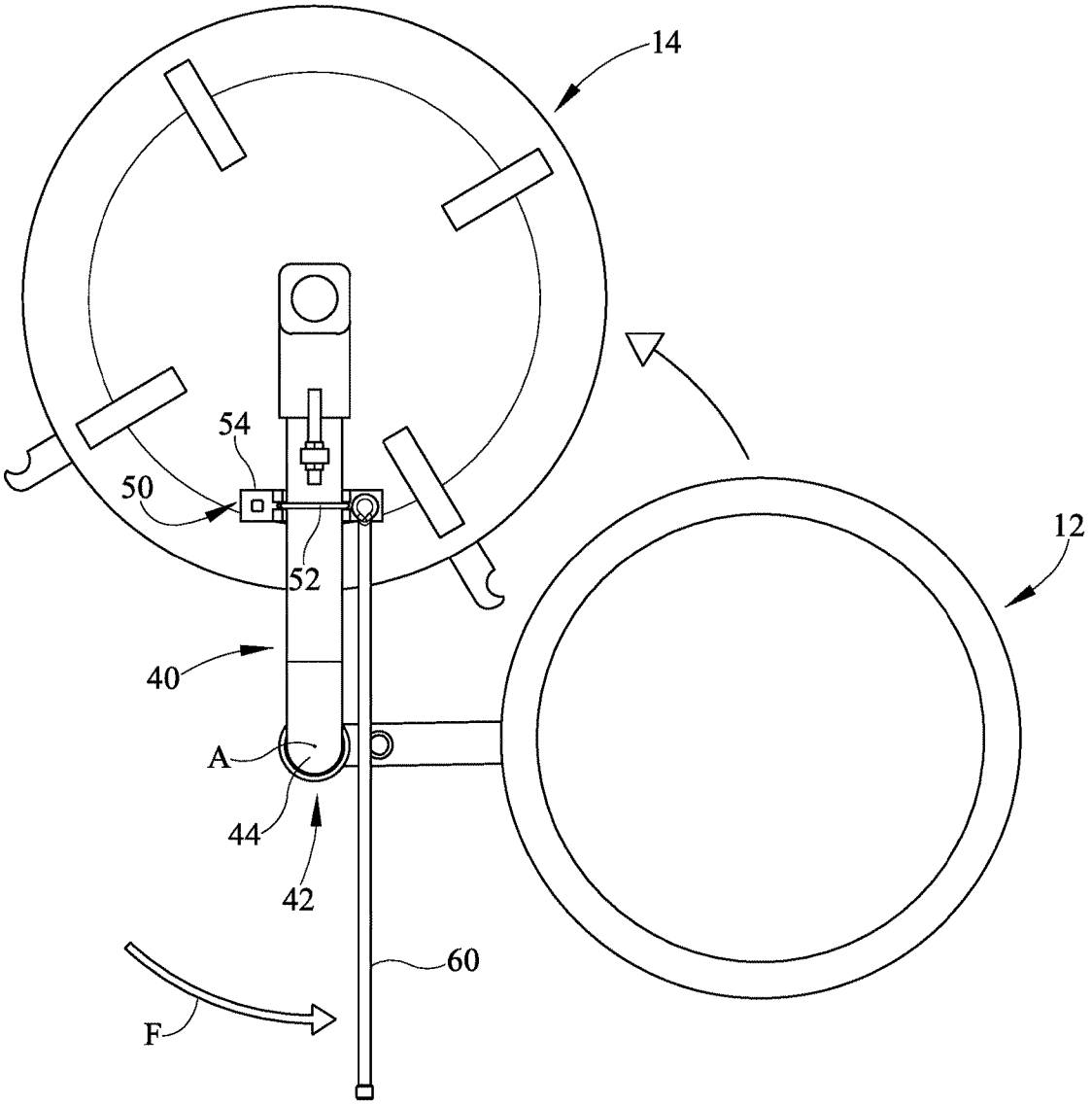
FIG. 4 is a top view of the closure assembly shown in an open position.

Referring now to FIG. 4, a top view is depicted wherein the head 14 is shown rotated away from the hub 12. An exemplary force F is shown applied to the bar 60 through the connector assembly 50. The head 14 pivots or rotates about the axis A extending into the page in the depicted view. In this view, the axis A is substantially vertical but may alternatively be at an angle to the vertical.

Figure 9:
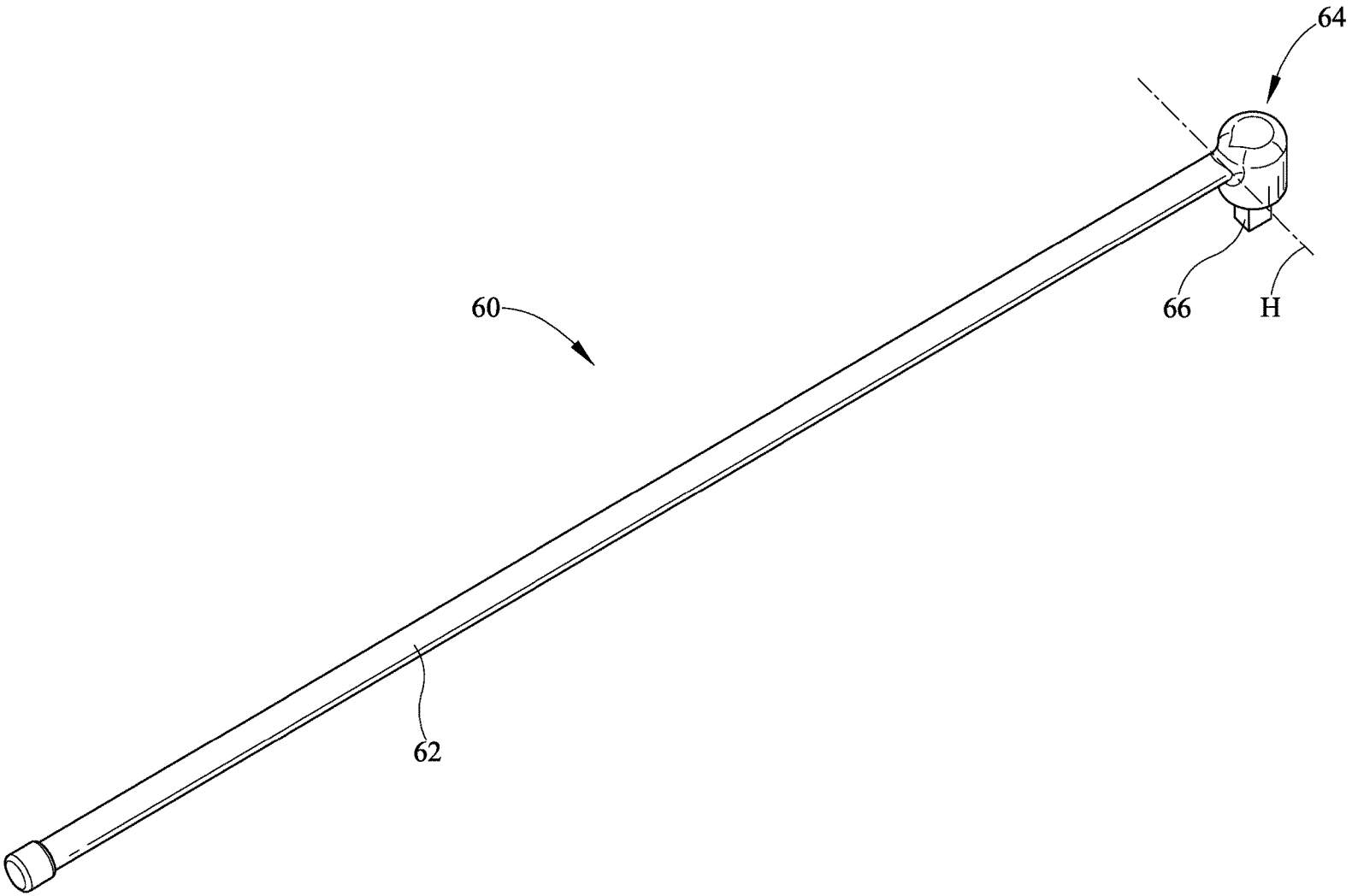
FIG. 9 is an isometric view of a bar which connects to the connector assembly of FIGS. 5-8 and 10-16.

In this view, the bar 60 is connected to the first embodiment of the connector assembly 50. The connector assembly 50 includes a U-shaped clamping bar 52 and at least one plate 54. The U-shaped bar extends about the davit 40. The block or plate 54 may include either of a hole 56 or a protuberance (556, 656). The hole 56 is used to engage the bar 60, which includes a mating protuberance 66 (FIG. 9). Alternatively, the bar 60 may comprise a hole wherein a mating protuberance or the block or plate 54 may be received. Underneath the plate 54, the U-shaped clamping bar 52 extend through the plate or block 54. In the instant embodiment, the clamping bar 52 is threaded so that nuts may be tightened against the plate or block 54. Although the assembly 50 is shown in various embodiments with the bar 52 on top of davit 40 and plate 54 on the bottom, the connector assembly 50 may be rotated into other orientations for example where plate or block 54 is vertically oriented.

With the connector assembly 50 in position, and the bar 60 engaging the plate 54, force may be applied to the bar 60, to create torque for rotation of the davit 40. As shown in this view, the bar 60 may extend parallel to the davit 40. However, other angles may be provided between the parts and the angle may be dependent on the engagement structures of the bar 60 and plate 54. Also, the orientation may depend on the angle of engagement of the bar 60 from which the user is located. Further, in some embodiments, it may be desirable that the bar 60 extend across the pivot axis A. This reduces the space needed to apply torque to the head 14 and pivot the head 14 and davit 40, which is desirable in confined spaces and/or located adjacent to a small platform, such as platform P (FIG. 1). In the depicted embodiment for example, the bar 60 is connected on the head side of the pivot axis A. The force F is applied on the opposite end of bar 60 and provides for movement when the head 14 is disconnected from the hub 12.

Figure 5:
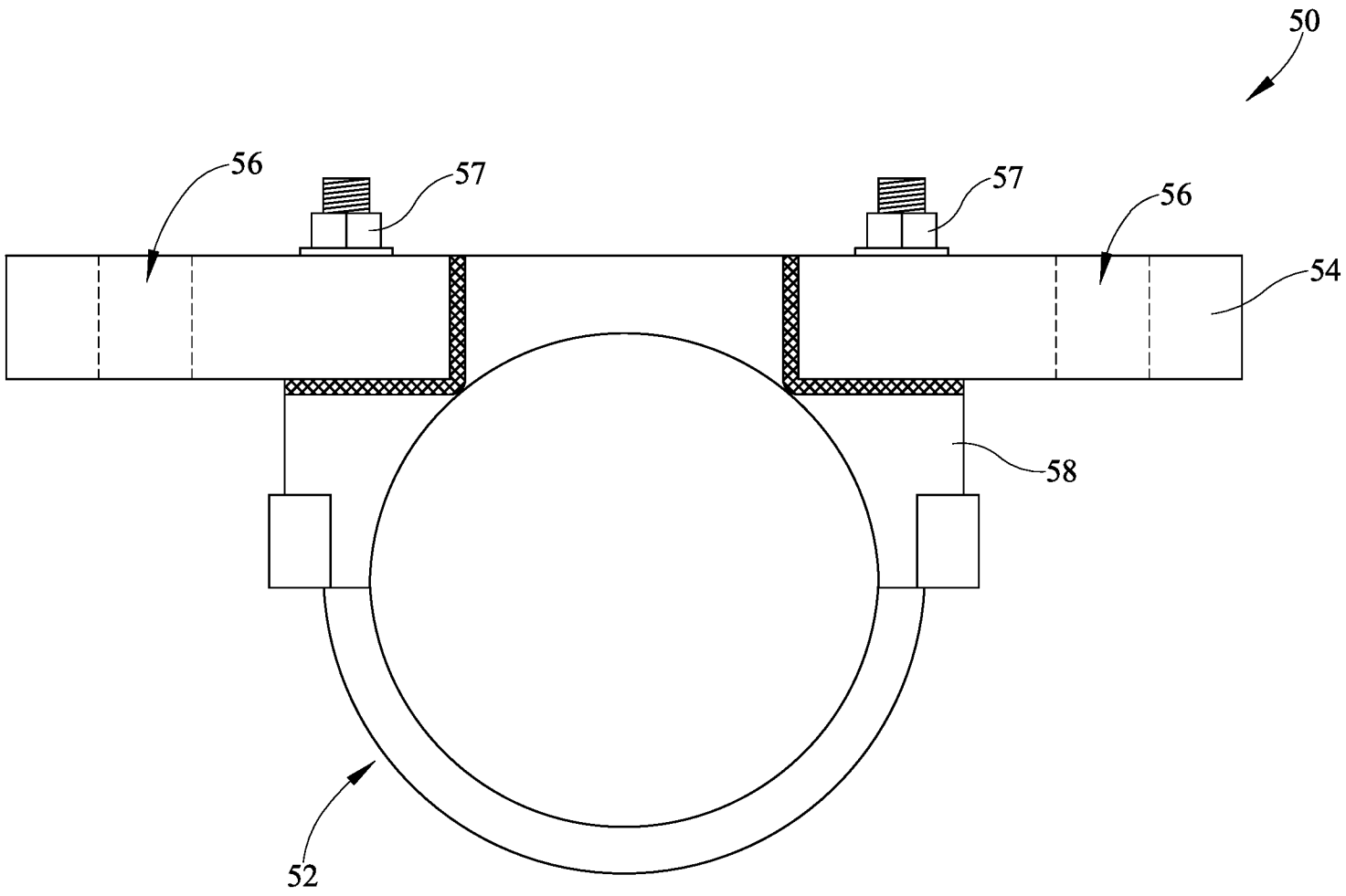
FIG. 5 is a front view of a first embodiment of an embodiment of a connector assembly which is connected to the closure assembly.
Figure 6:
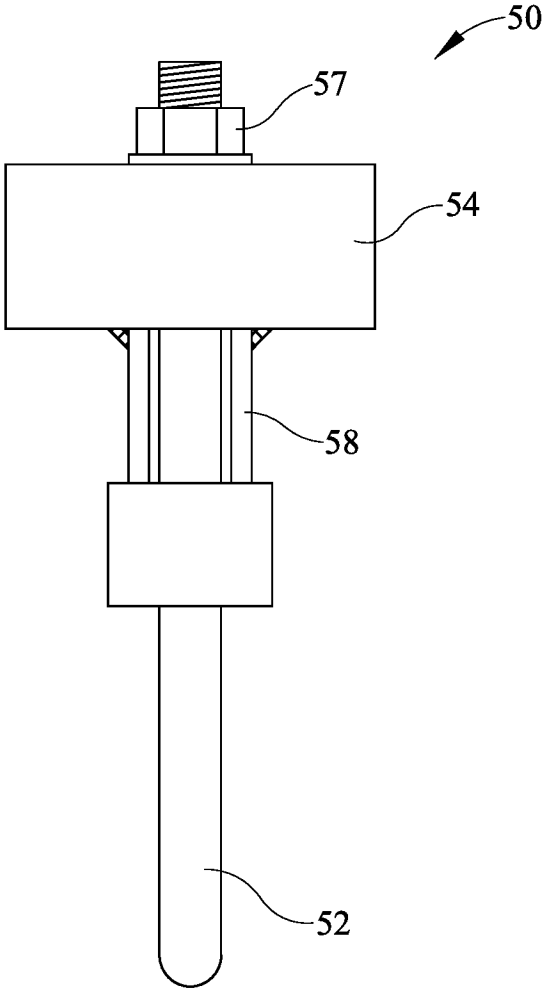
FIG. 6 is a side elevation view of the connector assembly of FIG. 5 which is connected to the closure assembly.
Figure 7:
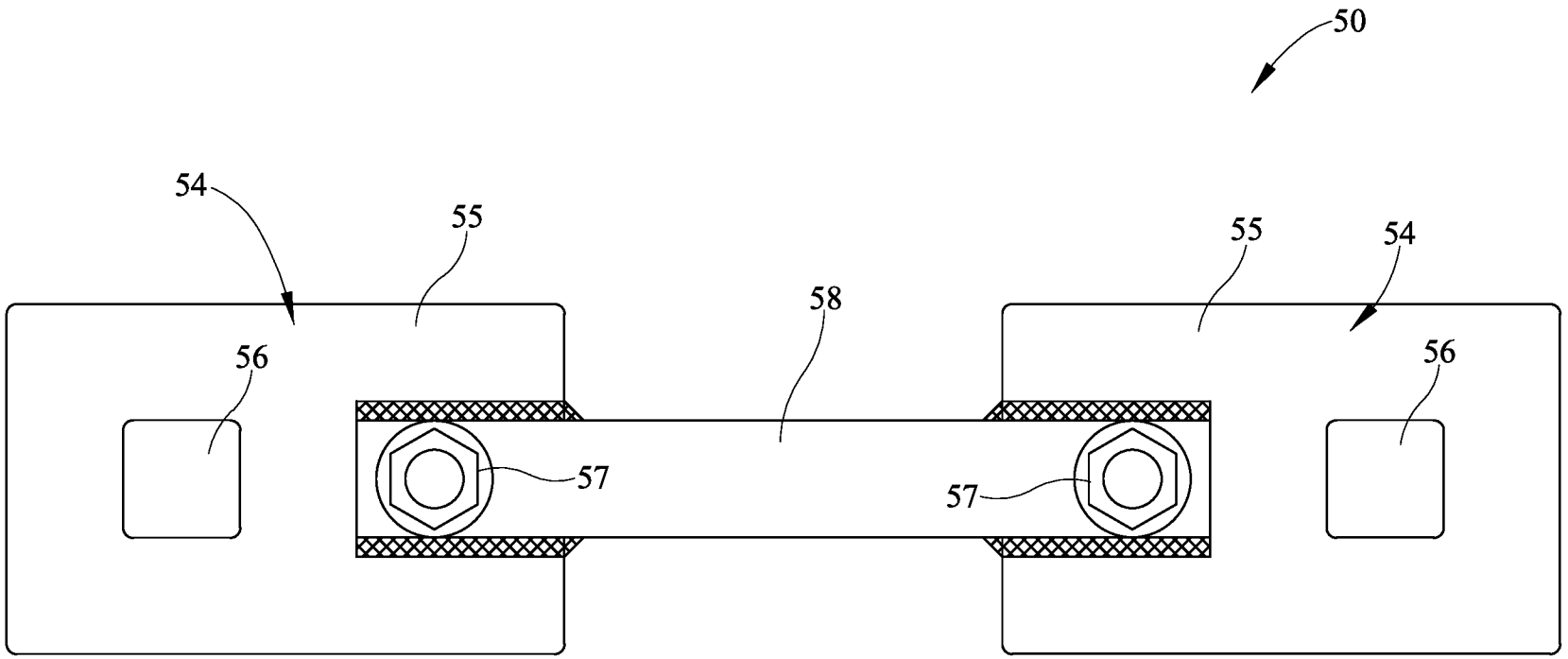
FIG. 7 is a top view of the connector assembly of FIG. 5 which is connected to the closure assembly.

Referring now to FIGS. 5-7, the connector assembly 50 is shown in various views. In the first view depicted in FIG. 5, the clamping bar 52 extends upwardly through the block or plate 54. The connector assembly 50 may be positioned on the davit 40 and rotated so that the plate 54 is horizontal, vertical or an angle therebetween, before tightening. The plate 54 may be a metallic material or other strong material. The plate 54 may be of a thickness which is equal to, less than or greater than a protuberance 66 (FIG. 9) located on the bar 60 (FIG. 9). The plate 54 has at least one aperture 56 which is depicted by broken through-lines. The apertures 56 may extend through completely or partially. The apertures 56 receive the protuberance 66 of the bar 60 so that the bar 60 is engaged with the plate 54. The holes 56 are square in the depicted embodiment. However, other embodiments may be utilized. For example, the holes 56 may be any of various geometric shapes including but not limited to hexagonal or octagonal, for example. The mating shape of protuberance 66 may fit into the aperture 56 so that surfaces, corners or both engage one another. The mating shapes of the bar 60 and plate 54 may match or may differ.

Also shown in the figure is a spacer support 58. The clamping bar 52 passes through the spacer support 58 and through the plate or block 54. The spacer support 58 provides a support for the bar 52 during tightening and during use to increase the strength of the connector assembly 50. The spacer support 58 and the plate or block 54 may be formed integrally or separately.

On the top of the top of the plate 54, are nuts 57 which connect the plate 54 and the clamping bar 52. As the nuts 57 are tightened, the clamping bar 52 is pulled against the davit 40 to retain the connector assembly 50 on the davit 40 and in the desired position at a desired orientation.

Referring now to FIG. 6, a side view of the connector assembly 50 is shown. The clamping bar 52 extends upwardly through the plate or block 54 and through the spacer support 58. The nut 57 is shown at the top of the plate 54 but the hole through the plate or block 54 is not shown. As can be seen in this view, as the nuts 57 are tightened in a first direction, the bar 52 is pulled upwardly about the davit 40 (FIG. 5).

Referring now to FIG. 7, a top view of the connector assembly 50 is shown. The plate or block 54 is shown with through holes 56 extending therein. In an alternative embodiment, a protuberance may be provided extending from the upper surface of the plate or block 54, rather than the hole 56. As shown in this embodiment, the plate 54 is formed of two pieces 55 and welded, as indicated by the hatched material, to the spacer support 58. In this orientation, each end 55 of the plate or block 54 is substantially U-shaped. With reference additionally to FIG. 5, the spacer support 58 extends into the opening of each u-shaped end 55 of the plate 54 and the spacer and ends 55.

In alternate embodiments, the assembly of the plate 54 and spacer support 58 may be formed integrally rather than welded after being formed separately.

A spacer support 58 is shown extending between the ends 55. The plate 54 and spacer support 58 may be formed of a single piece or may be formed of several pieces as shown.

Figure 8:
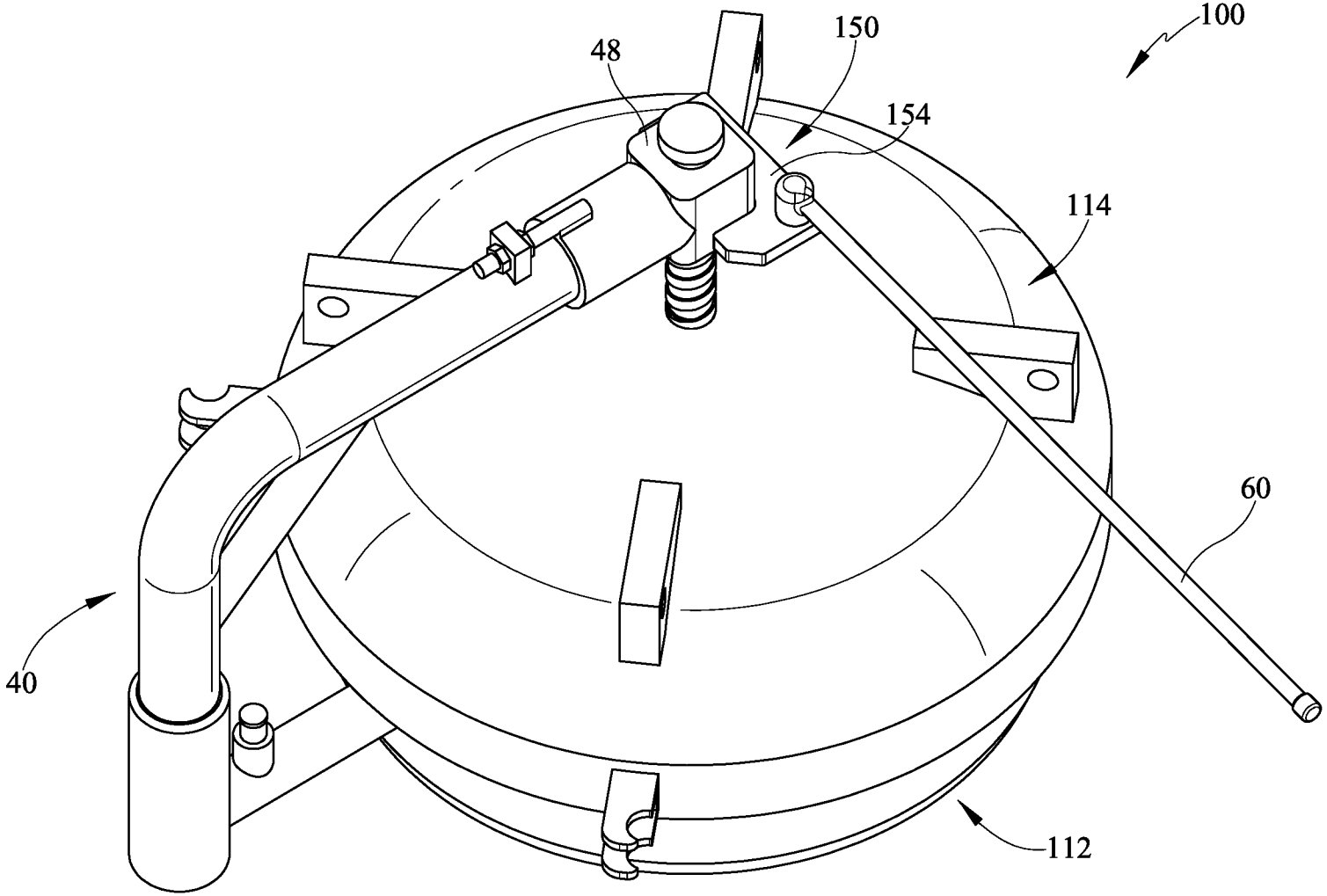
FIG. 8 is an isometric view of a second embodiment of a connector assembly.

Referring now to FIG. 8, an alternative embodiment is provided for the connector assembly 150. In the instant embodiment, the closure assembly 100 is provided with a hub 112 and a head 114. According to the instant embodiment, a connector assembly 150 is located at an end of the davit 40, for example at the davit post mount 48. The connector assembly 150 is defined by a plate 154 which extends from the mount 48 and provides a connection hole or protuberance, as previously described. As shown partially from above, the plate 154 is generally U-shaped. The plate 154 may be welded, integrally formed with mount 48, or may be fastened to the mount 48. The bar 60 is connected to the plate 154 by way of the connection hole or protuberance. Once the bar 60 is connected, the davit 40 and head 114 may be pivoted or rotated away from the hub 112.

The bar 60 is shown positioned at an angle of about 90 degrees to the horizontal portion of the davit 40. However the depicted embodiment is merely one exemplary position. Additional positions of the bar 60 may be utilized. The positioning of the bar 60 may be dependent upon where a platform, walkway or working space is located relative to the hub 112.

With reference to both FIGS. 5 and 8, the bar 60 may have a length which extends from the connector assembly 50, 150 across the pivot axis of davit 40. This allows for operation in small spaces. While bar 60 is shown extending perpendicular to davit 40 in FIG. 8, the bar 60 may be oriented in a number of directions. Further, since the connector assembly 50, 150 is adjustable on the davit 40, it may be positioned so that connection of the bar 60 is proper for the surrounding space. It is desirable to have as much lever arm distance as necessary and available based on the surrounding space.

Referring now to FIG. 9, the bar 60 is shown in isometric view. The bar 60 includes a handle 62 which may be formed of various materials, for example metallic or other stiff, but desirably light weight material and may have various cross-sectional shapes. The cross-sectional shape may be constant or may be of varying cross-sectional shape and is not limited to one shape. The bar 60 may be of various lengths from about one foot long, for example to about seven feet long.

At an end of the bar 60 is a bar head 64 which may or may not be pivoted about a horizontal axis H. This allows the rod handle 62 to change angle relative to the bar head 64. Alternatively, the connection between the handle 62 and the head 64 may be rigid to inhibit pivoting. On the head 64 is a protuberance 66. The exemplary protuberance 66 is a square shaped structure extending from the head 64. The protuberance 66 matches the size and shape of the aperture 56 of the connector assembly 50.

The protuberance 66 may also connect to the connector assembly 150. If the connector assembly 150 includes an aperture, then the protuberance 66 will connected as shown. However, in alternate embodiments, a protuberance may be disposed on either the connector assembly 50, 150 and the bar head 64 may comprise an aperture to engage such protuberance on the connector assembly. With the connector assembly 50, 150 fixed, and the protuberances fixed, rotation of the bar 60 causes rotation of the davit 40.

Figure 10:
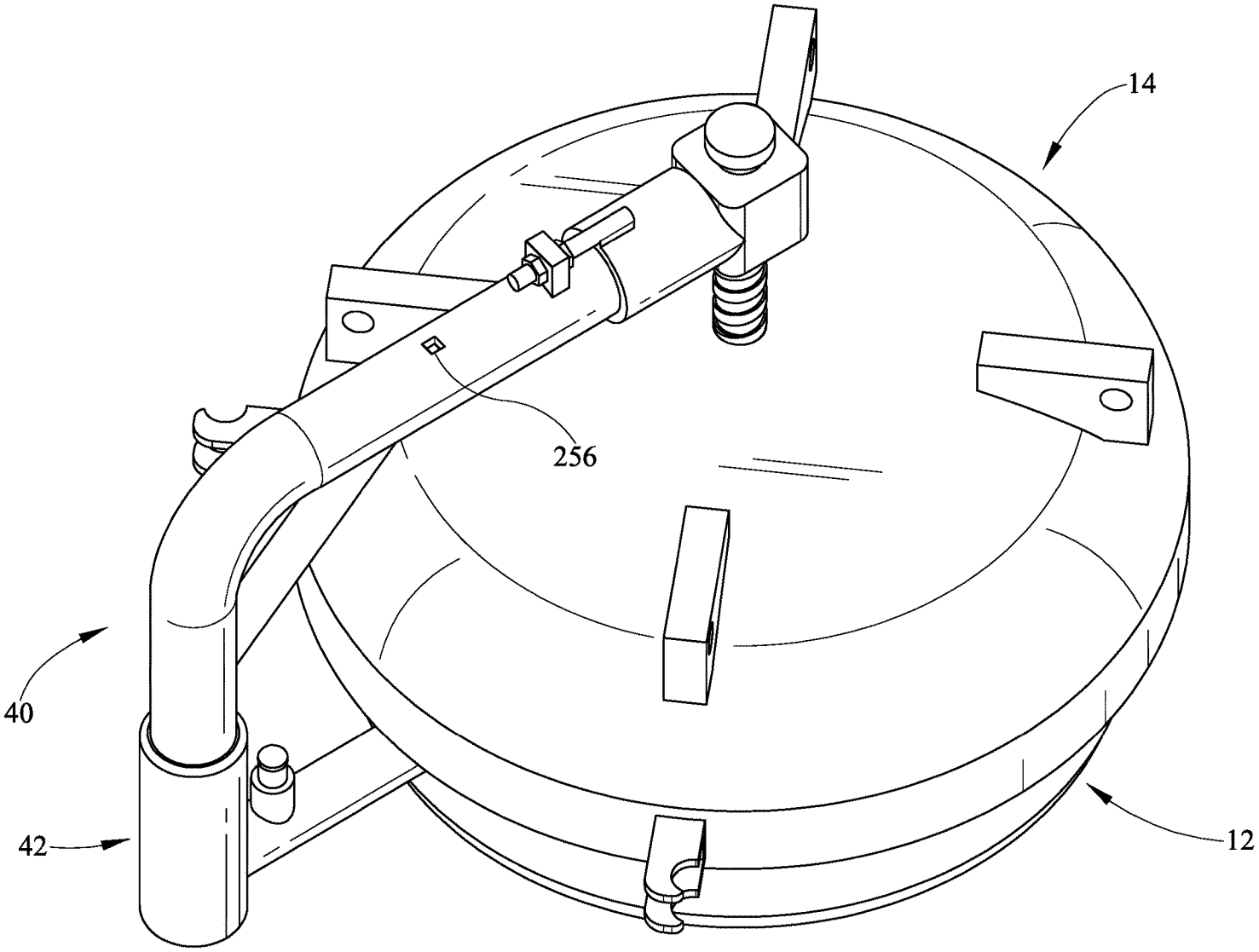
FIG. 10 is a first alternative connector assembly for connecting the bar.
Figure 11:
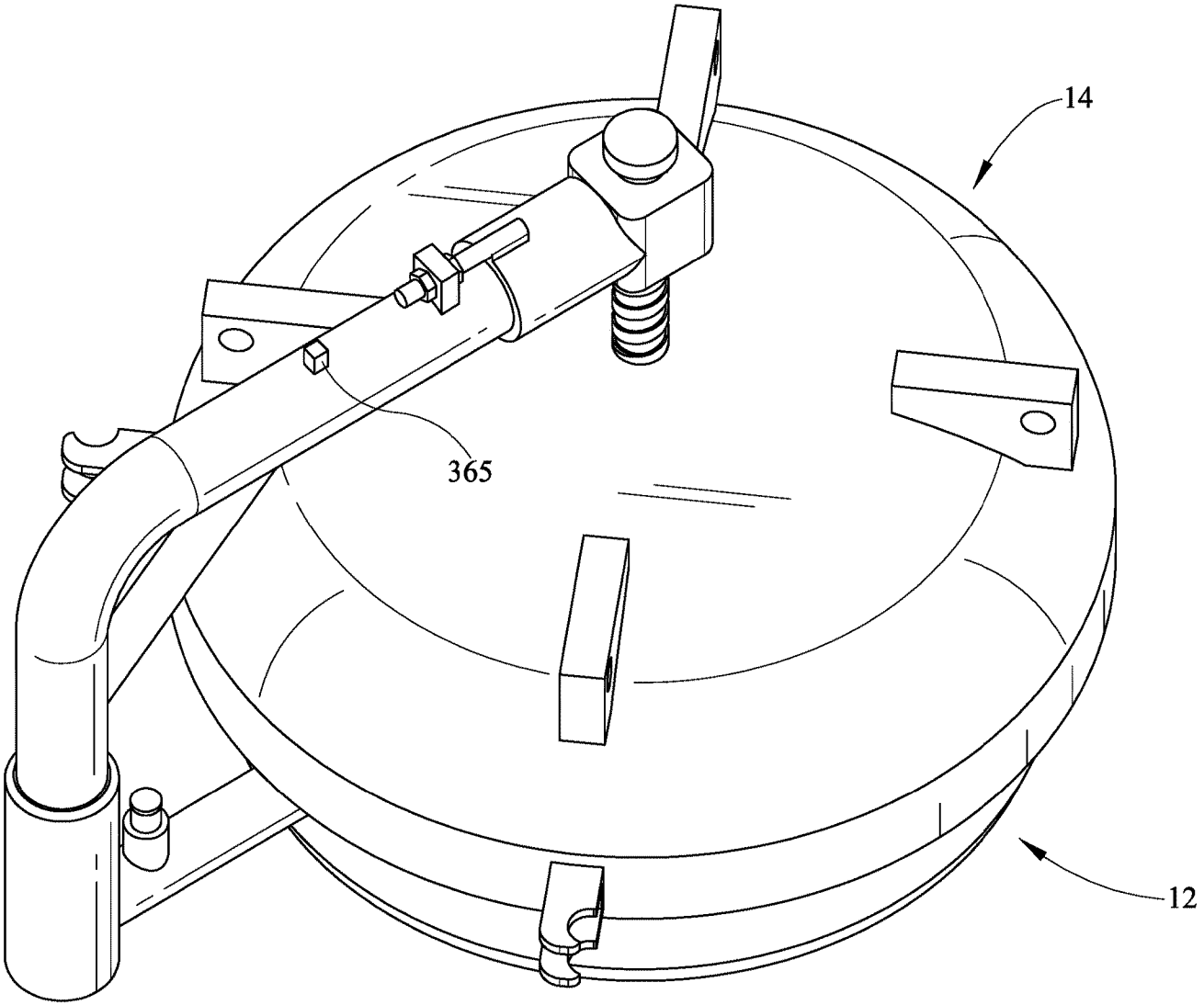
FIG. 11 is a second alternative connector assembly for connecting the bar.
Figure 12:
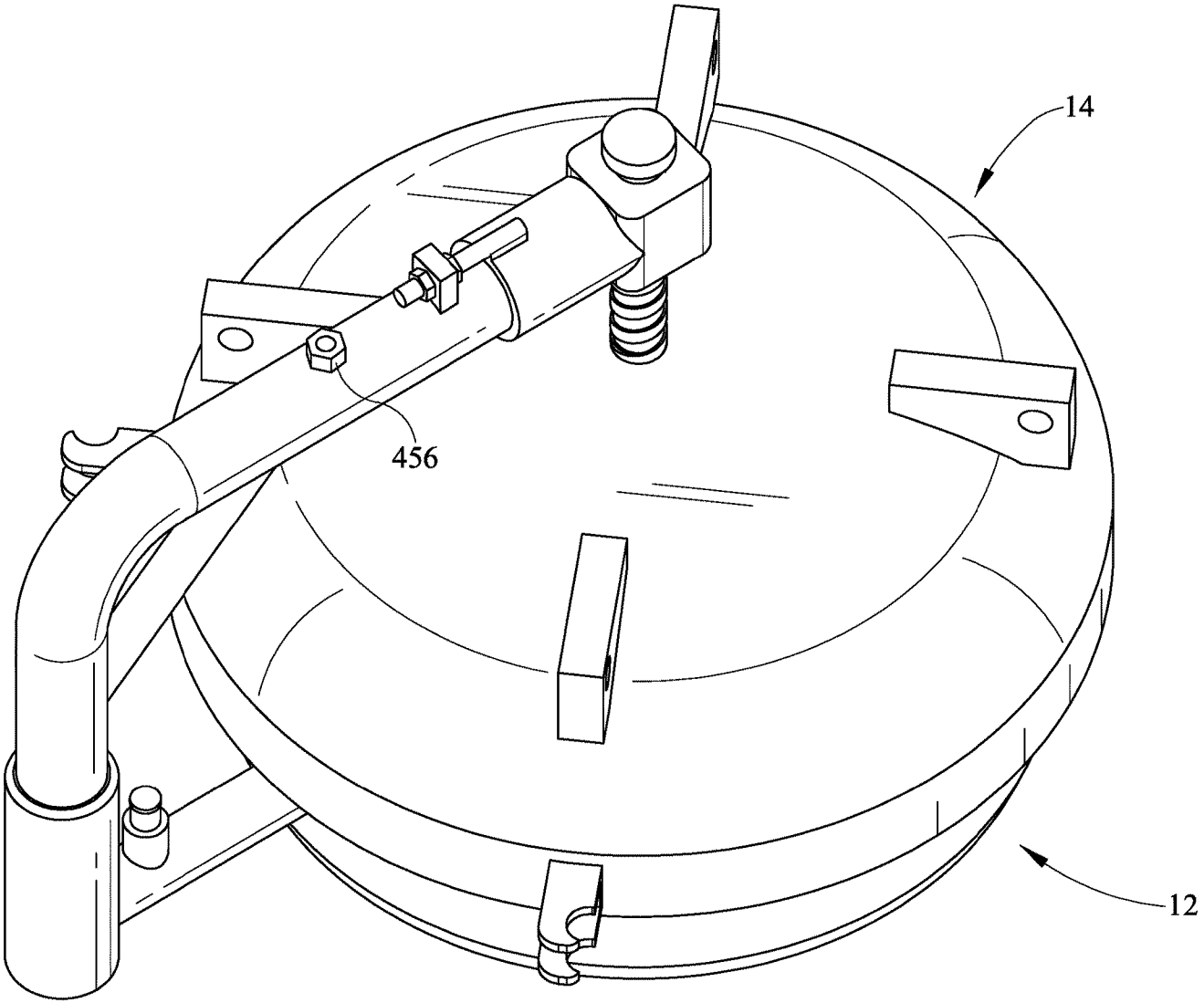
FIG. 12 is a third alternative connector assembly for connecting the bar.
Figure 13:
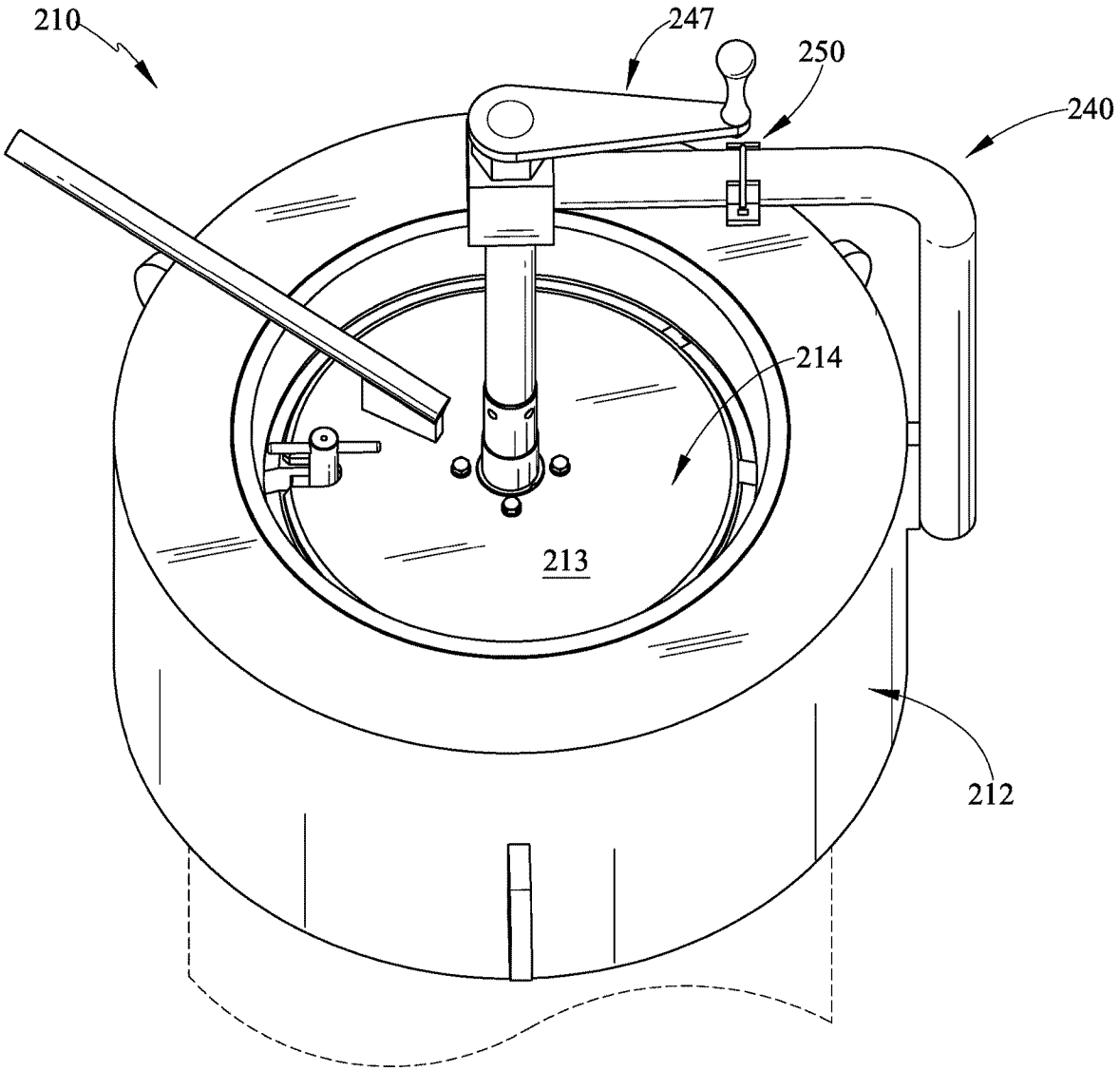
FIG. 13 is an isometric view of an alternative embodiment of the closure assembly.

Referring now to FIGS. 10-12, various alternative embodiments of connector assemblies are provided. First, with reference to FIG. 10, an aperture 256 is located on the davit 40. The aperture 256 is provided to receive the protuberance 66 of the bar head 64 (FIG. 9). The aperture 256 may be positioned at various locations spaced from the pivot assembly 42.

As an alternative, to the embodiment of FIG. 10, and with reference to FIG. 11, the embodiment depicts a protuberance 356 disposed on the davit 40. The protuberance 354 is square in cross-section but may alternatively be other shapes. The protuberance 354 may also be formed of other shapes. In such embodiment, the bar head 64 (FIG. 9) may be provided with an aperture therein.

Further, with reference to FIG. 12, an alternate protuberance shown as a nut 456 may be positioned on the davit 40. Other geometric shapes may be used for the protuberance however and the depicted embodiment should not be considered.

Still further embodiments are provided. First, with reference to FIG. 13, an alternative closure assembly 210 is provided in isometric view. The closure assembly 210 includes a hub 212 and a head 214. The head 214 differs in that instead of being dome shaped and fitting over the entire head 114 as with the previous embodiment, the head 214 is sized to fit within the opening or bore of the hub 212. The head 214 is shown positioned within the hub 212 in a closed orientation. A cover plate 213 is disposed over the head 214.

The closure assembly 210 also includes a davit 240 which is used to lift the head 214 from the hub 212. The davit 240 may include a vertical and a horizontal portion as in the previous embodiment so that the davit 240 can operably connect to raise and lower the head 214 relative to the hub 212. In the instant embodiment, the davit 140 is provided with a crank assembly 147 to raise and lower the head 214.

One skilled in the art will recognize that various types of head and hub configurations may be utilized with exemplary connector assemblies. In the instant exemplary embodiment, the connector assembly 50 is provided on the davit 240. The connector assembly 50 is provided to along the horizontal portion of the davit 240 and allows for tightening thereon. Once the connector assembly 50 is positioned on the davit 240, the head 214 and davit 240 may be rotated by connecting the bar 60 (FIG. 9).

Figure 14:
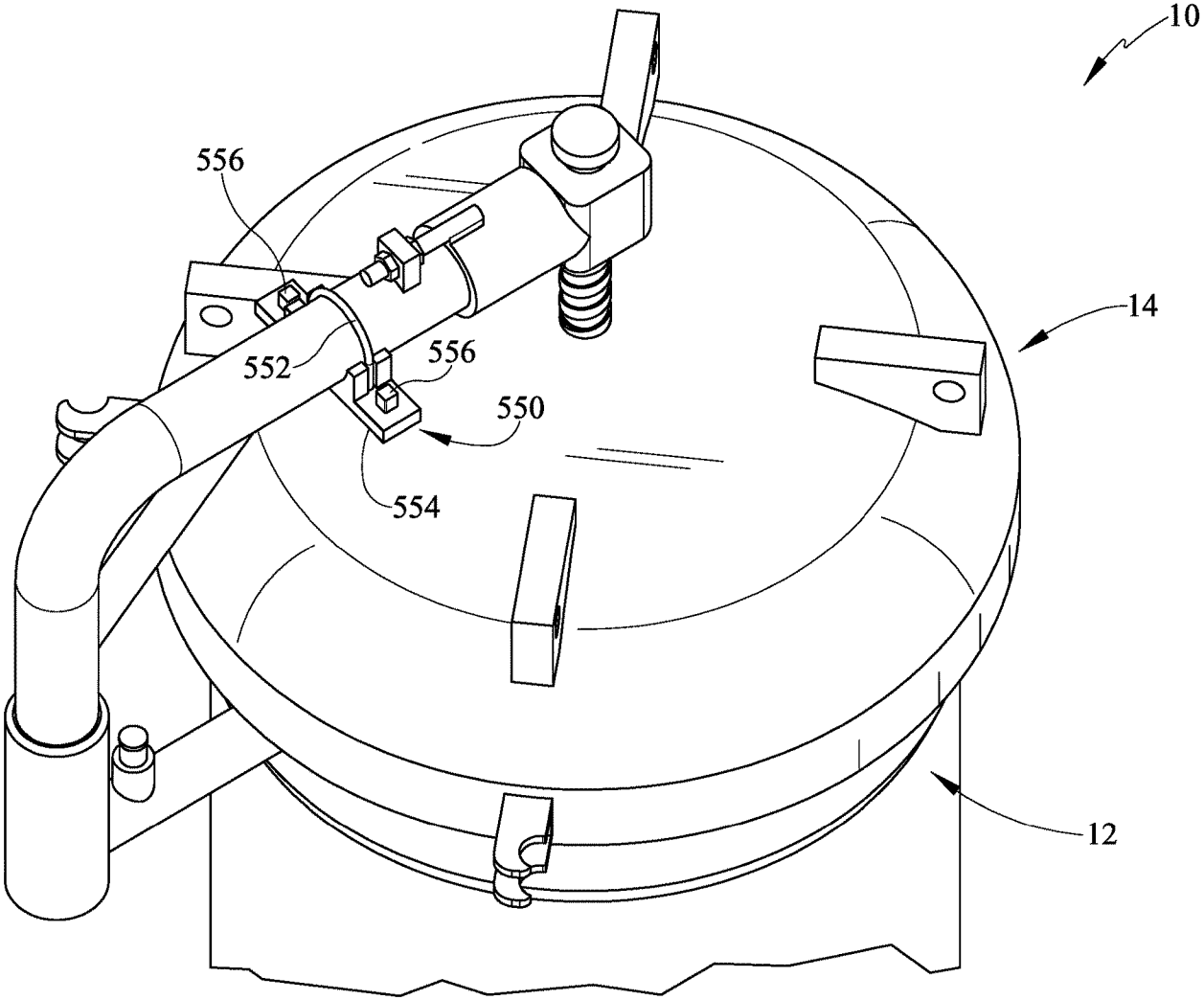
FIG. 14 is an isometric view of an alternative connector assembly on an exemplary closure assembly.

With reference now to FIG. 14, a connector assembly 550 is depicted. In this embodiment, the closure assembly 10 is shown with hub 12, the head 14 and the davit 40. Further in this embodiment, the davit 40 includes a connector assembly 550 including the at least one block or plate 554 and the clamp bar 552. As with previous embodiments, the assembly 550 may be rotated about the davit 40 until the connector assembly is in a desired orientation, before tightening.

The present embodiment of the connector assembly 550 differs in that a protuberance 556 is provided rather than the aperture 56 (FIG. 7). The protuberance 556 extends from the plate or block 554 so that the bar 60 can connect to the remainder of the assembly 550. In the instant embodiment, the protuberance 556 is shown extending upwardly but one skilled in the art may realize that depending on the desired orientation of the connection, the protuberances 556 may extend from the lower surface of plate 554.

Figure 15:
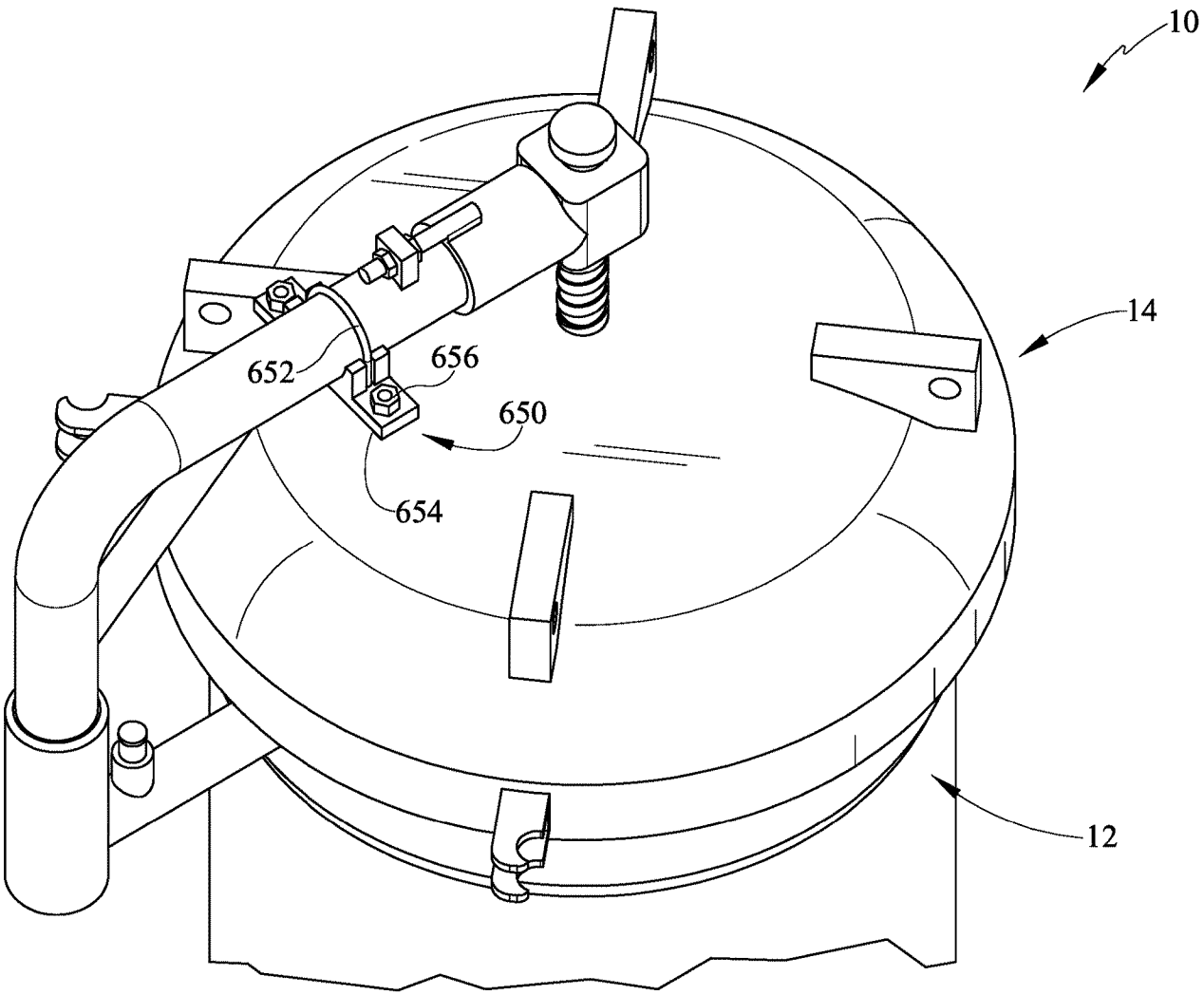
FIG. 15 is an isometric view of a further alternative connector assembly on an exemplary closure assembly.

With reference now to FIG. 15, a further alternative embodiment of the connector assembly 650 is depicted on a closure assembly 10. The connector assembly 650 is similar to the previously described embodiments except that the protuberance 656 located on plate 654 has an alternative shape. Whereas the protuberance 556 was square in cross section, the protuberance 656 is form of an alternate geometric shape, such as hexagonal. The exemplary shape is formed by a nut but may be formed of other shapes as well, as previously described.

Figure 16:
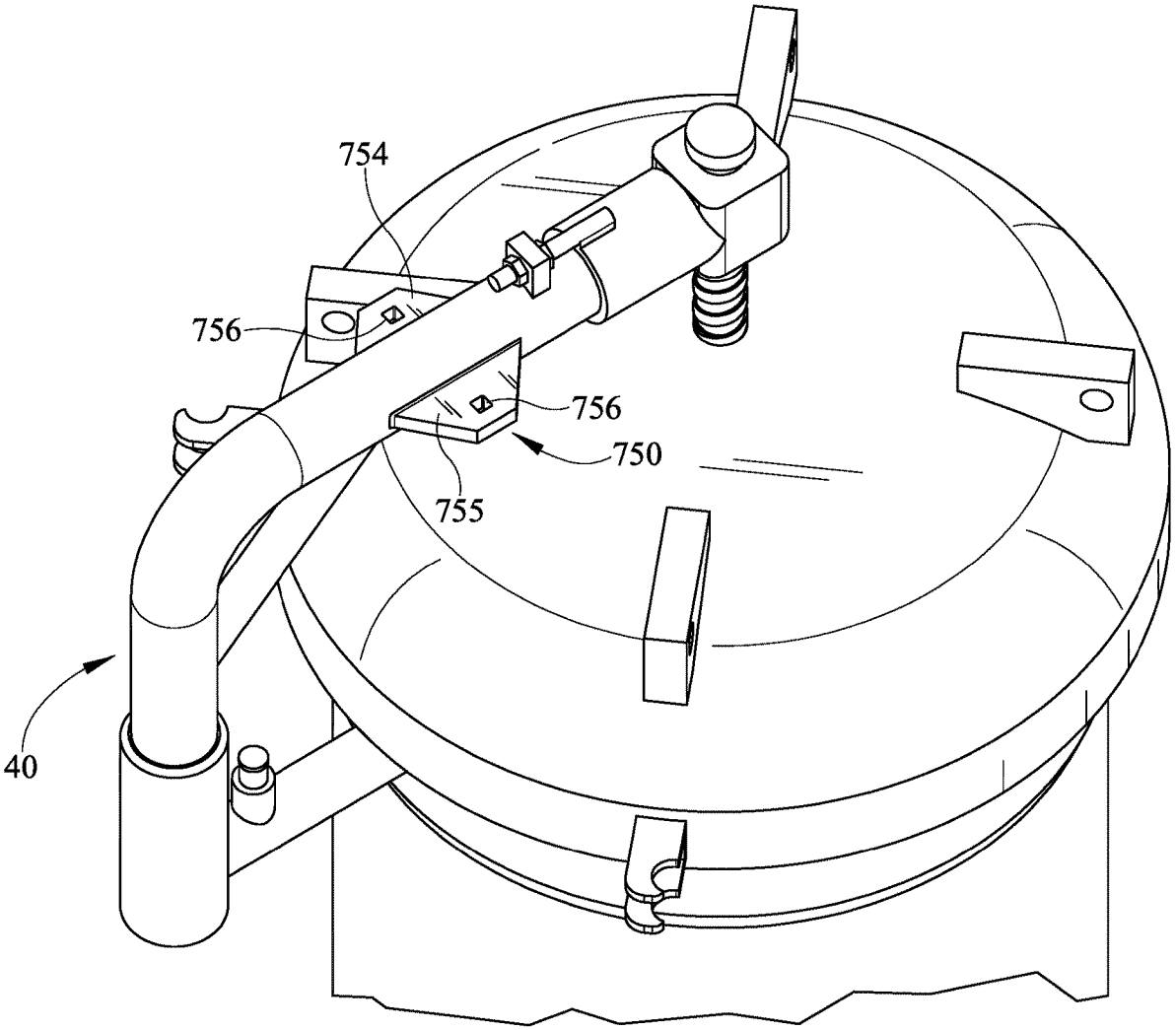
FIG. 16 is an isometric view of another alternative connector assembly of an exemplary closure assembly.

With reference now to FIG. 16, a further embodiment is depicted wherein the connector assembly 750 is provided in the form of two plates 754, 755 which are trapezoidal in shape, but alternative shapes may be used. The plates 754 are welded in the instant embodiment to the davit 40. The plates are shown extending horizontally, but in alternative embodiments and depending on the desired orientation of the application of force to rotate the davit 40, the plates 754 may be moved to extend at other positions, such as vertically or between horizontal and vertical positions, at an angle.

The plates 754 are also shown having apertures 756 to receive a protuberance extending from the bar head 64 (FIG. 9). The aperture 756 is generally square shaped however, the shape may vary and should mate with the protuberance of the bar head 64. Still further embodiments may be provided wherein the apertures 756 are replaced with the protuberances of the alternate embodiments, such as the protuberance 556 or the protuberance 656, or other shapes.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of" or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

What is claimed is:

1. A pressurized closure assembly, comprising:

a hub which is connectable to a pressure vessel, said hub having a central opening;

a head which engages said hub, said head movable between an opened and a closed position;

a davit positioned adjacent to said hub and extending upwardly to a position above said head for engagement with said head;

a davit post mount near an end of said davit, said davit post mount receiving a davit post and supporting said head during movement between said opened and closed positions;

said davit pivotable about a substantially vertical axis;

a connector assembly which is positioned near an end of said davit and said davit post mount, said connector assembly comprising a plate which is fixed to said davit post mount or the davit, the said plate having one of a hole or protuberance;

a bar having the other of a hole or protuberance at an end, wherein the bar is connectable to the connector assembly to aid in movement of the head.

2. The pressurized closure assembly of claim 1, wherein said plate is extending from the davit post mount.

3. The pressurized closure assembly of claim 2, said plate integrally connected to said davit post mount.

4. The pressurized closure assembly of claim 1, said plate integrally connected to one of said davit or said davit post mount.

5. The pressurized closure assembly of claim 1, said protuberance and said hole configured for mating connection.

6. The pressurized closure assembly of claim 1, said plate being one or more plates.

7. A pressurized closure assembly, comprising:

a hub which is connectable to a pressure vessel, said hub having a central opening;

a head which engages said hub, said head movable between an opened and a closed position;

a davit positioned adjacent said hub and extending upwardly to a position above said head for engagement with said head;

a davit post mount near an end of said davit, said davit post mount receiving a davit post and supporting said head during movement between said opened and closed positions;

said davit pivotable about a substantially vertical axis;

a connector assembly on said davit comprising a plate permanently and fixedly connected to said davit, said plate having one of a hole or protuberance; a bar having the other of a hole or protuberance at an end, wherein the bar is connectable to the plate to aid in movement of the head.

8. The pressurized closure assembly of claim 7, said plate being a first plate and a second plate spaced apart along said davit.

9. The pressurized closure assembly of claim 8, said first and second plates extending horizontally from said davit.

10. The pressurized closure assembly of claim 8, said first plate and said second plate disposed on a horizontally extending portion of said davit.

11. The pressurized closure assembly of claim 7, said first plate and second plate being spaced from a pivot location of said davit.

12. The pressurized closure assembly of claim 7, said connector assembly and said bar increasing torque to pivot said head away from said hub.

* * * * *